US006963700B2

(12) United States Patent
Shimizu et al.

(10) Patent No.: US 6,963,700 B2
(45) Date of Patent: Nov. 8, 2005

(54) IMAGE FORMING APPARATUS WITH VARIABLE SPEED CHARGING MEMBER

(75) Inventors: Yasushi Shimizu, Shizuoka-ken (JP); Junichi Kato, Shizuoka-ken (JP); Hiroshi Satoh, Mishima (JP); Masahiro Yoshida, Yokohama (JP); Hiroyuki Oba, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 76 days.

(21) Appl. No.: 10/132,374

(22) Filed: Apr. 26, 2002

(65) Prior Publication Data

US 2002/0181965 A1 Dec. 5, 2002

(30) Foreign Application Priority Data

Apr. 27, 2001 (JP) ..... 2001-132164

(51) Int. Cl.[7] ..... G03G 15/02; G03G 15/08

(52) U.S. Cl. ..... 399/50; 399/149

(58) Field of Search ..... 399/50, 149, 150, 399/174, 176, 168

(56) References Cited

U.S. PATENT DOCUMENTS

| | | | | |
|---|---|---|---|---|
| 4,469,435 A | * | 9/1984 | Nosaki et al. | 399/148 |
| 5,066,979 A | | 11/1991 | Goto et al. | 355/208 |
| 5,353,104 A | | 10/1994 | Kato et al. | 355/259 |
| 5,519,472 A | | 5/1996 | Ojima et al. | 355/246 |
| 5,682,585 A | | 10/1997 | Yamaguchi et al. | 399/274 |
| 5,805,951 A | | 9/1998 | Kato et al. | 399/26 |
| 5,809,379 A | | 9/1998 | Yano et al. | 399/159 |
| 6,035,150 A | | 3/2000 | Domon et al. | 399/27 |
| 6,081,681 A | | 6/2000 | Nagase et al. | 399/174 |
| 6,128,456 A | | 10/2000 | Chigono et al. | 399/176 |
| 6,134,407 A | | 10/2000 | Ishiyama et al. | 399/174 |
| 6,163,663 A | | 12/2000 | Shinohara et al. | 399/55 |
| 6,167,212 A | | 12/2000 | Satoh et al. | 399/55 |
| 6,226,464 B1 | | 5/2001 | Suwa et al. | 399/27 |
| 6,272,306 B1 | | 8/2001 | Saito et al. | 399/270 |
| 6,370,348 B1 | | 4/2002 | Okano et al. | 399/256 |
| 6,496,663 B2 | * | 12/2002 | Shimizu et al. | 399/50 |

FOREIGN PATENT DOCUMENTS

| | | |
|---|---|---|
| JP | 3-236082 | * 10/1991 |
| JP | 6-3921 | 1/1994 |

* cited by examiner

*Primary Examiner*—Quana Grainger
(74) *Attorney, Agent, or Firm*—Fitzpatrick, Cella, Harper & Scinto

(57) ABSTRACT

An image forming apparatus includes an image bearing member; a charging member, contactable to the image bearing member, for electrically charging the image bearing member at a charging position; developing means for developing an electrostatic image formed on the image bearing member with a developer; wherein when a first area on the image bearing member which is going to be an image formation area is at the charging position, the charging member moves with a peripheral speed difference relative to the image bearing member, and when a second area on the image bearing member which is a part of an area which is going to be a non-image formation area is at the charging position, the charging member moves substantially without a peripheral speed difference relative to the image bearing member, and wherein a collecting electric field is formed for collecting the developer from the second area to the developing means.

11 Claims, 10 Drawing Sheets

IMAGE FORMING APPARATUS WITH VARIABLE SPEED CHARGING MEMBER

FIELD OF THE INVENTION AND RELATED ART

The present invention relates to an image forming apparatus such as an electrophotographic apparatus, electrostatic recording apparatus or the like which is suitable for a cleanerless system and which uses contact charging as charging means for electrically charging an image bearing member such as an electrophotographic photosensitive member, dielectric member for electrostatic recording or the like. The image forming apparatus such as an electrophotographic apparatus requires an electric charging step of charging the image bearing member uniformly to a predetermined potential in order to form an electrostatic latent image on the image bearing member such as an electrophotographic photosensitive member, dielectric member for electrostatic recording or the like. For this purpose, a non-contact type corona charger or the like has been used as a means for the charging.

However, the corona charger produces ozone and requires such a high voltage as approx. 10 KV has to be applied between the charging device and the image bearing member.

Recently, a charging means has been proposed to avoid these problems. In such a means, a charge member is directly contacted to the image bearing member and is supplied with a voltage by which the image bearing member is charged uniformly (so-called contact charging device).

Referring first to FIG. 7, there is shown a typical contact charging device as a charging roller 2-x. The charging roller 2-x comprises an electroconductive base roller, an intermediate resistance surface layer, and the roller is codirectionally rotated by an image bearing member 1 with peripheral movement in the direction indicated by arrow f (rotational direction a). Between the roller and the image bearing member 1, a predetermined voltage is applied from a voltage source S1, so that image bearing member 1 is electrically charged to a uniform potential.

Here, the voltage applied to the roller may be (1) a DC voltage only or (2) a DC voltage biased with an AC voltage.

(1) In the case of (1), in order to charge the image bearing member 1 to a potential of −600V, the applied voltage is approx. −1300V, and in the case of (2), the applied DC voltage is −600V and the AC voltage is not less than 1500Vpp.

The charging mechanism in these cases is based on the Paschen's law, and an electric discharge phenomenon arises in a region satisfying the Paschen's law in which the distance between the charging roller 2-X-a and the image bearing member 1 is within a predetermined range (region H in FIG. 7).

However, as will be understood from the charging mechanism, the contact charging device of this type creates the discharge which is the same as with the corona charger within a fine space region H, and therefore, the ozone is produced although the amount of ozone production is remarkably smaller than with the corona charger. The ozone produces nitrogen oxide, and if it is deposited on the image bearing member 1, an image defect is produced due to the low resistance of the deposited matter.

This injection charging process is proposed in Japanese Laid-open Patent Application Hei 6-3921, which process is free of such a problem of ozone generation, and therefore, the voltage applied to the charging device can be further reduced.

A feature of the charging process is that surface potential of the charged image bearing member is substantially the same as the voltage applied to the charging device. This system does not use the electric discharge phenomenon, and charge injection occurs into the image bearing member by the transfer of electric charges between the surface of the image bearing member and the charge member contacted thereto. As for a charging device for implementing the injection charging process, some types of injection charging devices are proposed. FIG. 8 shows a charging device 2-Y of a magnetic brush type as one of the typical types.

The magnetic brush type injection charging device comprises a magnet 2-Y-a, a charging sleeve 2-Y-b enclosing it, and magnet carrier 2-Y-c or the like deposited on the surface of the sleeve.

The magnet 2-Y-a is fixed, but the charging sleeve 2-Y-b rotates and attracts the magnet carrier 2-Y-c by the magnetic force of the magnet 2-Y-a and feeds the magnet carrier 2-Y-c in the direction indicated by an arrow b.

The amount of the magnet carrier 2-Y-c on the charging sleeve 2-Y-b is regulated by the regulating blade 2-Y-d.

The charging sleeve 2-Y-b is disposed close to the image bearing member 1, and there always a portion where t magnet carrier 2-Y-c on the charging sleeve 2-Y-b is contacted to the image bearing member 1. Here, the magnet carrier 2-Y-c is made of magnetic and electroconductive material.

In this system, the regulating blade 2-Y-d is supplied with a DC voltage of −600V from a voltage source S1. Therefore, the portion contacted to the carrier 2-Y-c on the image bearing member 1 tends to have the same potential. At this time, if the charge is injected into the image bearing member 1 from the magnet carrier 2-Y-c side beyond an energy barrier on the surface of the image bearing member 1, the image bearing member 1 is electrically charged. If not, or if the charge moves back from the image bearing member 1 to the magnet carrier 2-Y-c side at positions where the magnet carrier 2-Y-c and the image bearing member 1 are apart from each other, the image bearing member 1 is not charged. This phenomenon is dependent on the energy barrier of the surface of the image bearing member 1 and/or the charge retention power. On the other hand, when it is taken as a competitive reaction, a frequency of chance of contact between the magnet carrier 2-Y-c side and the image bearing member 1 is important. In order to increase the frequency of contacts, the particle sizes of the magnet carrier particles 2-Y-c is made small, and/or the magnetic force of the magnet 2-Y-a is increased so as to raise the density of the magnet carrier 2-Y-c, and in addition, the rotational direction b of the charging sleeve 2-Y-b is such that peripheral movement of the charging sleeve 2-Y-b and that of the image bearing member 1 are opposite from each other (increase of the relative speed), thus increasing the number of contacts per unit time.

In this manner, the magnet carrier 2-Y-c and the electroconductive particle Z which establish injection sites of the charge to the image bearing member 1 are contacted to the image bearing member 1 at high opportunity, so that surface potential of the image bearing member 1 becomes substantially the same potential, that is, −600V applied to the charging sleeve 2-Y-b. Microscopically, uniform charging is accomplished.

However, when such a system is implemented, a mechanism is required to hold the magnet carrier 2-Y-c in which sealing is difficult.

An improved charging device is disclosed in U.S. Pat. Nos. 6,134,407, 6,081,681 and 6,128,456, that is, a sponge charging roller. This type is shown in FIG. 9. Relatively low resistance electroconductive particles Z are deposited in the pore portion of the surface of a charging sponge roller 2-A contacted to the image bearing member 1 and rotated in a direction indicated by an arrow b. The electroconductive particles Z corresponds to the magnet carrier 2-Y-c in the above-discussed said magnetic brush type.

Such a charging process has a feature that surface potential of the image bearing member 1 can be charged to a potential substantially equal to the voltage applied to the charging device substantially without using the electric discharge phenomenon, wherein the charge injection is effected into the image bearing member 1 by direct transfer of the charge between the charging member and the surface of the image bearing member 1 contacted thereto. A charging sponge roller 2-A (charging roller) of an electroconductive sponge carries electroconductive particles Z deposited on its surface and rotates in such a direction that surface there is moved counterdirectionally (b) relative to the peripheral moving direction (a) of the image bearing member 1 at a nip C formed between t image bearing member 1 and the charging sponge roller, while injecting charge into the image bearing member 1 from the charging sponge roller 2-A. By this, the image bearing member 1 is charged to a potential substantially equal to the potential of the charging sponge roller 2-A.

The electroconductive particles are fine electroconductive particles (charging-promotion particle) for assisting the charging. The electroconductive particles are metal oxide or the like having a volume resistivity of not more than $1\times10^{12}$ Ωcm, with or without electroconductive inorganic fine particles, organic material mixed therewith.

In this system, the charging sponge roller 2-A is supplied with a DC voltage of −600V from a voltage source S1. Therefore, the surface potential of the image bearing member 1 tends to become the same potential at the portions where the charging sponge roller 2-A and the electroconductive particle z are contacted. At this time, if the charge is injected into the image bearing member 1 from the charging sponge roller 2-A side beyond an energy barrier on the surface of the image bearing member 1, the image bearing member 1 is electrically charged. If not, or if the charge moves back from the image bearing member 1 to the charging sponge roller 2-A side at positions where the charging sponge roller 2-A and the image bearing member 1 are apart from each other, the image bearing member 1 is not charged. This phenomenon is dependent on the energy barrier of the surface of the image bearing member 1 and/or the charge retention power. On the other hand, when it is taken as a competitive reaction, a frequency of chance of contact between the charging sponge roller 2-A side and the image bearing member 1 is important. In order to increase the frequency, electroconductive particles Z having small particle size are deposited on the surface of the charging sponge roller 2-A so as to increase the injection sites in the contact portion C between the image bearing member 1 and the charging sponge roller 2-A, and in addition, the charging sponge roller 2-A is rotated in the peripheral counterdirectional direction so as to increase the relative speed between the image bearing member 1 and the charging sponge roller 2-A, thus increasing the number of contact to the image bearing member 1 in the injection sites per unit time.

In this manner, the charging sponge roller 2-A and the electroconductive particle Z which establish injection sites of the charge to the image bearing member 1 are contacted to the image bearing member 1 at high opportunity, so that surface potential of the image bearing member 1 becomes substantially the same potential, that is, −600V applied to the charging sponge roller 2-A. Microscopically, uniform charging is accomplished.

FIG. 10 is a schematic view of an example of a transfer type electrophotographic apparatus of a cleanerless system type wherein the charging means for the image bearing member 1 is an injection charge device 2 using the electroconductive particles Z as described above, and no cleaner exclusively for cleaning the image beam member 1 is used.

Designated by reference numeral 1 is an electrophotographic photosensitive member of a rotatable drum type (image bearing member), wherein rotated at a predetermined peripheral speed in the clockwise direction indicated by an arrow a. Designated by 2-A is a charging sponge roller, which is contacted to the image bearing member 1 with a predetermined urging force to provide a contact portion (charging nip) C having a predetermined width. On the outer surface of the charging sponge roller 2, charging sponge rollers 2 are deposited beforehand. The charging sponge roller 2 is rotated in the clockwise direction indicated by an arrow b, by which the charging sponge roller 2 is rotated counterdirectionally with respect to the peripheral movement of the image bearing member 1 at the contact portion C relative to the image bearing member 1, and the charging sponge roller 2 is supplied with a predetermined charging bias from the voltage source S1, by which the outer surface of the image bearing member 1 is uniformly charged by charge injection to a predetermined potential of a predetermined polarity.

The surface of the image bearing member 1 thus uniformly charged is exposed to image light L by unshown exposure means (digital scanning exposure device such as a laser beam scanner or the like. Image projecting device for projecting an image of an original document, so that electrostatic latent image is formed corresponding to the exposure image pattern on the uniformly charged surface of the image bearing member 1.

Then, the electrostatic latent image is visualized into a developed image (toner image) by a developing sleeve 3-*a* in a jumping developing device 3 of a non-contact type. Designated by S2 is a voltage source for applying a predetermined developing bias voltage to the developing sleeve 3-*a*.

Then, the developed image is transfer, at a transfer portion where a transfer roller 5-*a* of a transferring device 5 is contacted to the image bearing member 1 onto a transfer sheet P (recording material sheet fed from an unshown sheet feeder at predetermined controlled timing. Designated by S3 is a voltage source for applying a predetermined transfer bias to the transferring device 5.

The recording material P is separated from the image bearing member 1 after receiving the developed image at the transfer portion and is introduced into an unshown fixing device, where the image is fixed. Then, the recording material P is discharged as a print (or copy).

After the separation of the recording material, the residual developer remaining on the surface of the image bearing member 1 is carried back to the developing zone by way of the continuing rotation of the image bearing member 1, and is collected into the developing device 3 (simultaneous development and cleaning).

Here, the electroconductive particle retaining force of the charging sponge roller 2-A is not strong, and therefore, a system for stably supplying the electroconductive particles Z to the charging sponge roller 2-A is provided. In this system, the electroconductive particles Z are mixed in the developer T in the developing container 3-*d* of the developing device 3, so that the electroconductive particles Z are supplied to the charging sponge roller 2-A by way of the image bearing member 1, that is, supplied to the image bearing member 1 through the non-contact jumping developing device 3 and then carried on the image bearing member 1 to the position of the charging sponge roller 2-A.

In the non-contact jumping developing device 3, the electroconductive particles Z are supplied when the developer T is supplied to the image bearing member 1 for development. The charging polarity of the electroconductive particles Z is selected so as to be opposite the regular charging polarity of the developer T, so that they are not transferred onto the transfer sheet P by the transfer roller 5-*a* but remains on the image bearing member 1. Then, they are collected by the sponge roller 2-A which is rotating counterdirectionally relative to peripheral movement of the image bearing member 1.

This system is a so-called cleanerless system in which no cleaning process for collecting the developer T between the charging step and the transfer step in the image formation process. If an attempt is made to implement the cleanerless system of this example in a conventional type contact charging device or the like described above, the residual developer T after the transfer step appears as it is in the next formed image. In this example, however, the charging sponge roller 2-A of the elastic member is rotated in the counterdirectional peripheral movement relative to the image bearing member 1, the residual developer T is scraped, and therefore, no influence i imparted to the next image. Most of the developer T deposited on the charging sponge roller 2-A is discharged to the image bearing member 1 at a relatively early stage, and thereafter is collection into the developing device 3 when it passes through the developing zone. Therefore, the cleanerless electrophotographic process is accomplished.

Such an image forming apparatus has a feature that electroconductive particles Z which are to be injection sites in the charging step, are mixed in the developer T in the developing container 3-*d* of the developing device 3, so that electroconductive particles Z are supplied to the charging sponge roller 2-A by the electrophotographic apparatus using the non-contact type jumping developing device 3. The electroconductive particles Z reach the charging sponge roller 2-A from the developing device 3 by way of the route indicated by a thick curved line.

The supply of the electroconductive particles Z to the image bearing member 1 is made by the non-contact type jumping developing device 3 together with the developing operation for the image bearing member 1 with the developer T. The charging polarity of the electroconductive particles Z is selected so as to be opposite the regular charging polarity of the developer T, so that they are not transferred onto the transfer sheet P but remains on the image bearing member 1. Then, they are collected by the sponge roller 2-A, thus providing new injection sites. Therefore, the problems with the holding method for the particles or the sealing property which are the problems in the foregoing type can be avoided with a simple structure.

In this type of the system, there is no cleaning process for removing particles deposited on the image bearing member 1 between the transfer step and the charging step, since the electroconductive particles Z are supplied to the charging device using the developing process. If the cleanerless system of this example is employed in the above-described conventional contact charging device or the like, residual developer T which is mainly charged to the positive polarity appears in the next formed image (image defect). In this example, however, the elastic charging sponge roller 2-A is rotated in a counterdirectional peripheral moving direction relative to the peripheral movement of the image bearing member 1, by which the residual developer T is scraped, and therefore, no influence to the next image formation is imparted. If the developer T deposited on the charging sponge roller 2-A accumulates, the resistance of the charging sponge roller 2-A rises with the result of deterioration of the charging property. In the normal image forming operation, however, the charge injection occurs into the residual developer T when it passes between he electroconductive particles Z and the image bearing member 1 under the charging operation, similarly to the injection into the image bearing member 1. Therefore, proper charge can be maintained. For this reason, the developer is assuredly caught and collected by the developing device 3 when it is introduced into the developing zone. Therefore, the cleanerless electrophotographic process is accomplished.

In order to assuring the charging power in the injection charging device 2, it is important to assure many injection sites between the charging member and the image bearing member 1 irrespective of whether the charging member is magnetic brush or sponge roller. In view of this, the charging member is rotated at a high speed relative to the image bearing member 1 to accomplish high density injection site relative to the image bearing member 1, so that high charging property is provided.

When the cleanerless system is employed in said injection charging device, the charging member is not so contaminated with the developer T as to significantly deteriorate the charging property. If, however, the amount of the developer T discharged on the image bearing member 1 from the transfer roller 5-*a* in the transferring device 5 after the image formation, is large, or is a transfer sheet P is jammed, a large amount of the developer T stagnates at the inlet portion J of the contact portion C. As described, the charging member is normally rotated with a peripheral speed difference relative to the image bearing member 1. When it is rotated in the peripheral counterdirection relative to the image bearing member 1, it functions to scrape the developer T from the surface of the image bearing member 1 and deposit them on the charging member. When the charging member rotates in the codirectional peripheral moving direction, there still is a peripheral speed difference relative to the image bearing member 1. Because of this, more developer T is deposited on the charging member which has a higher retaining force.

In such a case, it is difficult to quickly return a large amount of the deposited developer T to the image bearing member 1, with the result of temporary deterioration of the charging power of the charging member.

Particularly, after a long term use, the developer T has been accumulated on the charging member, and therefore, the total charging power is not abundant enough (less margin). If the above-described phenomenon occurs, the uniform charging may not be possible with the possible result of a great number of black dots on a white image.

Even if the situation is not that bad, if the residual developer T is deposited on the charging member in the form of stripes, the latent image involves the corresponding non-uniformity. When a half-tone image is developed, the half-tone density involves a non-uniformity in the form of stripes.

As described in the foregoing, after a large amount of the developer T is accumulated with time on the charging member, a larger amount of the developer T than in an usual image forming process is always discharged from the charging member onto the image bearing member 1 for a certain period of time. Then, during the image formation, the image exposure by the laser beam is blocked, with the result of defective latent image formation.

Because of the larger amount of the developer T than usual is discharged onto the image bearing member 1, the developer T may be temporarily unable to be completely collected by the developing process with the result of the developer T transferred onto the transfer sheet.

It is usually only during the developing process that bias is applied between the image bearing member 1 and the developing device 3, and therefore, even if the developer T is discharged from the charging member during rotations of the image bearing member 1 and the charging member in other periods, they are not collected into the developing device 3. Rather, they are collected again by the charging member or contaminates the transferring device or the like contacted to the image bearing member 1 with the developer T.

SUMMARY OF THE INVENTION

These and other objects, features and advantages of the present invention will become more apparent upon a consideration of the following description of the preferred embodiments of the present invention taken in conjunction with the accompanying drawings.

Accordingly, it is a principal object of the present invention to provide an image forming apparatus in which a large amount of a developer deposited on the image bearing member is transferred onto the charging member when the image forming operation is not carried out. It is another object of the present invention to provide an image forming apparatus in which when a large amount of the developer is deposited on the image bearing member, the developer is permitted to simply pass by the charging member when the image forming operation is not carried out. It is a further object of the present invention to provide an image forming apparatus in which the developer remaining on the image bearing member during normal image forming operation, is permitted to simply pass by the charging member. It is a further object of the present invention to provide an image forming apparatus in which a residual developer on an image bearing member can be collected by a developing device when the image forming operation is not carried out. It is a further object of the present invention to provide an image forming apparatus which is suitable for a cleanerless type apparatus which is not provided with a cleaner exclusively for removing the residual developer from the image bearing member. It is a further object of the present invention to provide an image forming apparatus with which the problem of deterioration of the charging property attributable to deposition of the developer onto the charging member and/or the problem of image deterioration attributable to the developer discharge from the charging member. It is a further object of the present invention to provide an image forming apparatus in which deposition of a large amount of the developer on the charging member from the image bearing member after jam clearance operation, and the developer is efficiently collected without adverse influence to a series of image forming process which is normally carried out in response to the collection of the developer into the developing device from the image bearing member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS (First Embodiment)

Figure 1:
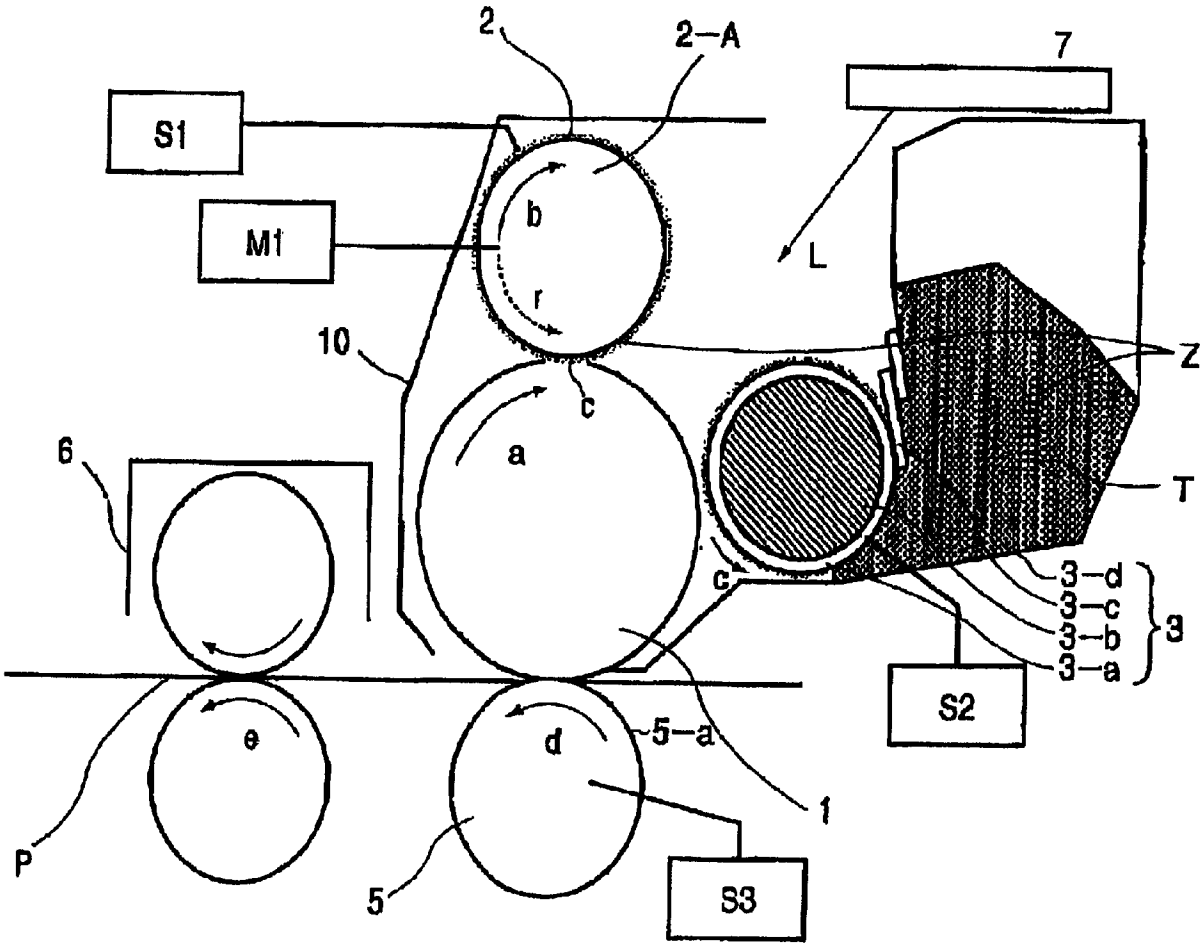
FIG. 1 is a schematic view of an image forming apparatus according to a first embodiment of the present invention.
Figure 7:
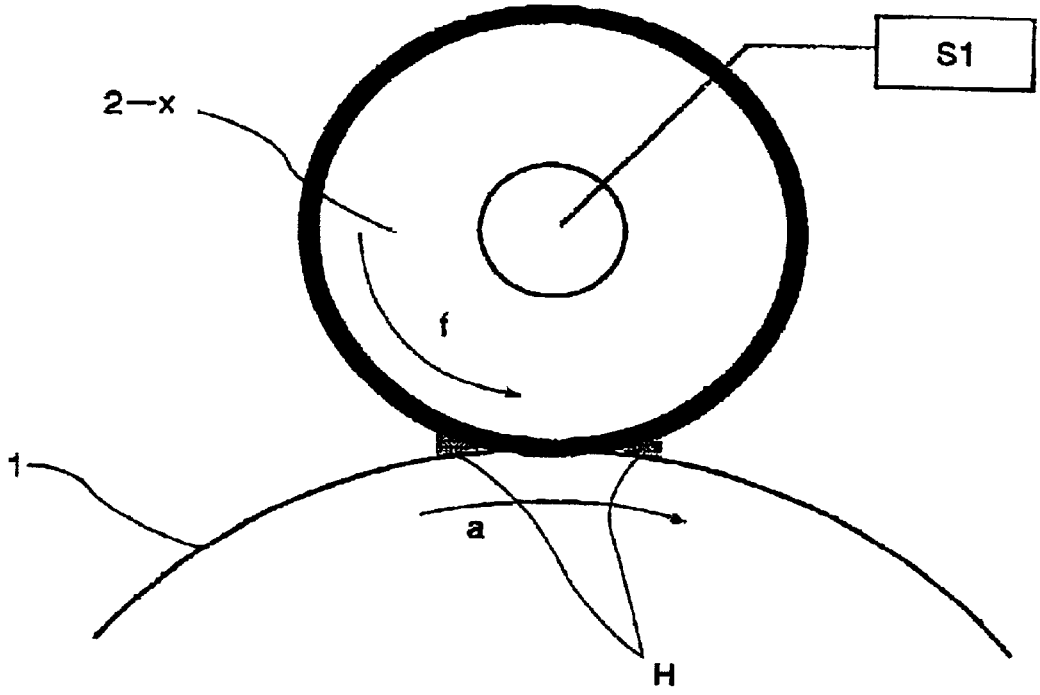
FIG. 7 is an illustration of a roller charging.
Figure 8:
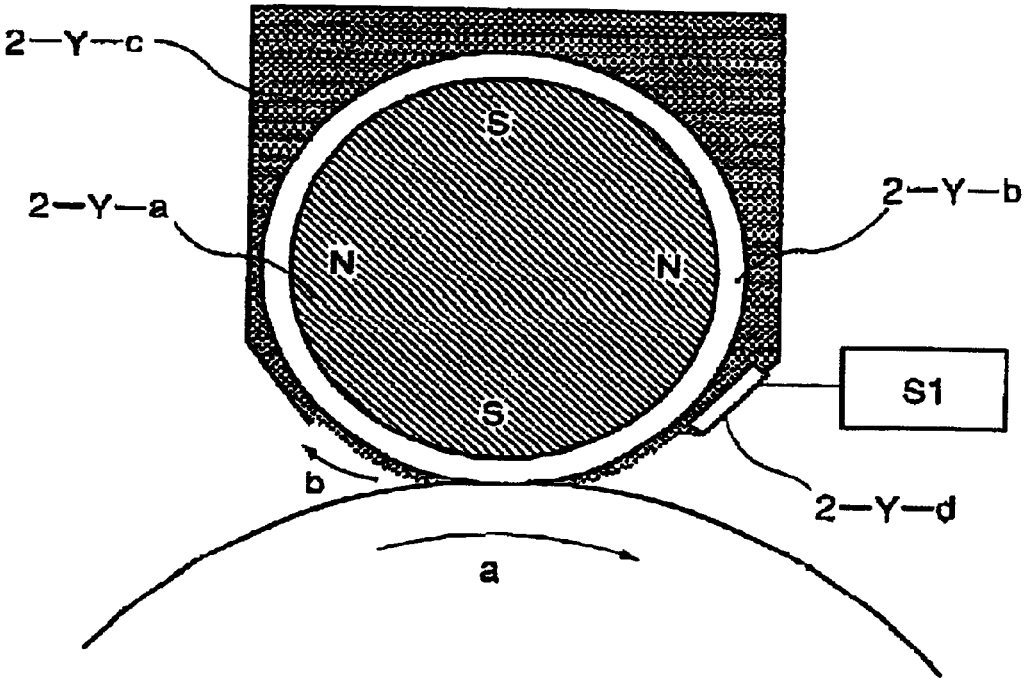
FIG. 8 is an illustration of magnetic brush charging.
Figure 9:
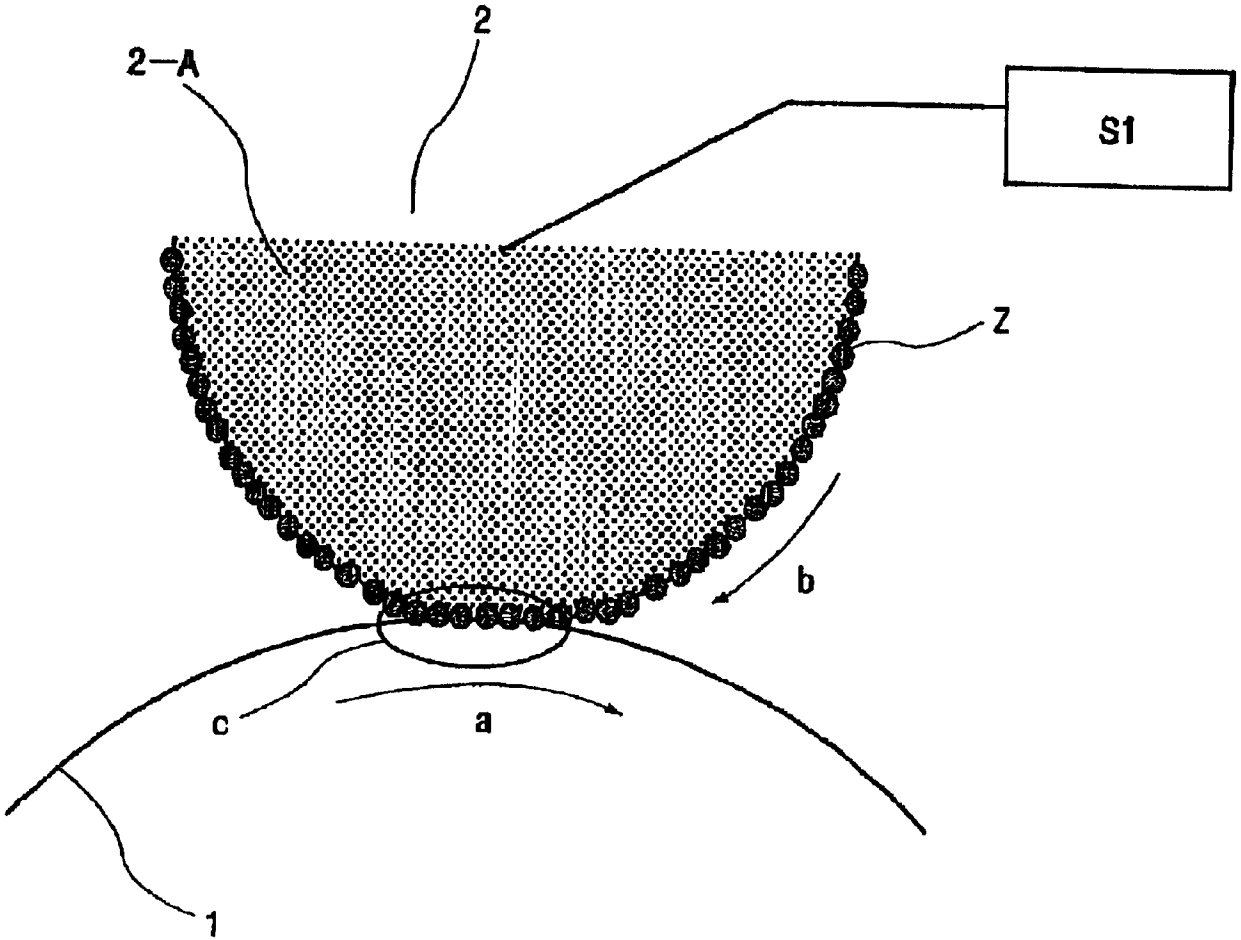
FIG. 9 is an illustration of injection charging using electroconductive particles.
Figure 10:
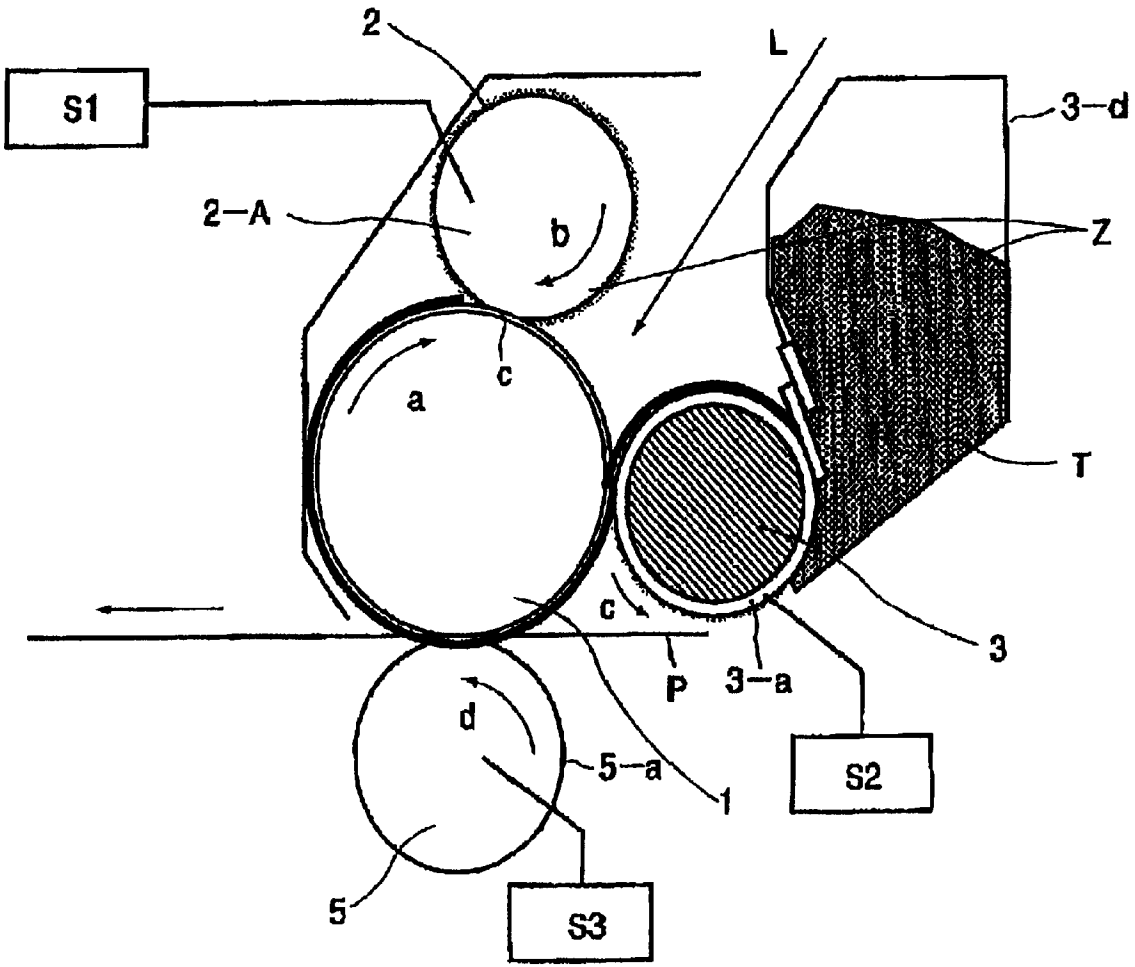
FIG. 10 is a schematic view of a cleanerless system image forming apparatus using an injection charging type with electroconductive particles.

FIG. 1 is a schematic sectional view of an image forming apparatus according to the embodiments of the present invention. Similarly to the image forming apparatus shown in FIG. 7, the charging means for electrically charging the image bearing member 1 is an injection charging device 2 using electroconductive particles Z, and the image forming apparatus is a cleanerless system transfer type electrophotographic apparatus.

More particularly, it comprises the image bearing member (photosensitive member) 1, the injection charging device 2, a developing device 3 accommodating a mixture of a developer T and the electroconductive particle Z, a transferring device 5, a fixing device 6, an exposure device 7 and so on. The image bearing member 1, the injection charging device 2 and the developing device 3 are unified into a process cartridge 10, which is detachably mountable to the main assembly of the image forming apparatus which includes the transferring device 5, the fixing device 6 and the exposure device 7.

An image (developed image) is formed on the image bearing member 1 through a latent image step and a developing process, and is transferred onto a transfer sheet P (recording material) which is fed by a rotation, in the direction d, of the transfer roller 5-*a* of the transferring device 5 toward the fixing device 6, and image on the transfer sheet is fixing TV on the transfer sheet P by the fixing device 6. The transfer sheet P now having the fixed image is discharged in a rotational direction e of the fixing device 6. The charging step for the image bearing member 1 during the latent image step is carried out using the injection charging device 2 comprising a charging sponge roller 2-A coated with electroconductive particles Z. The charging sponge roller 2-A comprises an electroconductive roller having a hardness of 30°, an average pore diameter of 50 $\mu$m, and is contacted to the image bearing member 1 and rotated in such a direction that peripheral moving direction of the charging roller 2-A is opposite (arrow b) the peripheral moving direction of the image bearing member (arrow a) at a contact portion (nip) C between the image bearing member 1 and the charging roller 2-A. The surface speed thereof is the same as that of the image bearing member 1 during the image formation, that is, the relative peripheral speed relative to the surface of the image bearing member 1 is 200%.

The electroconductive particles Z are electroconductive zinc oxide particles have an average particle size of 3 $\mu$m, a resistivity of $10^6$ Ω cm, including the secondary aggregate.

The charging polarity of the electroconductive particles Z is positive which is opposite the regular charging polarity of the developer T (negative). As described with respect to conventional example, the electroconductive particles Z are mainly deposited on the pore portion of the sponge and covers the surface of the charging sponge roller 2-A.

Here, for the portion of the surface of the image bearing member 1 which is going to be an image formation area, the charging sponge roller 2-A is supplied with a voltage of −610V relative to the image bearing member 1 from a voltage source S1. Therefore, in the region C where the image bearing member 1 and the charging sponge roller 2-A are contacted to each other, the surface potential of the image bearing member 1 tends to become the same potential as the potential −610V of the charging sponge roller 2-A, and the charge is induced to the surface of the image bearing member 1.

When the surface of the charging sponge roller 2-A is separating from the surface of the image bearing member 1, the movement of the charge occurs such that charge on the image bearing member 1 decreases. However, the amount of the decrease is dependent on the resistance values of the charging sponge roller 2-A and the electroconductive particles, the resistance value of the image bearing member 1 and the layer structure. In this embodiment, the amount of the decrease is made as small as possible by proper selections in this embodiment, more particularly, it is 10V, so that resultant surface potential of the image bearing member is −600V.

After the charging step, the light L directed from the exposure device 7 for electrostatic latent image formation in accordance with the image information is incident on the surface of the image bearing member 1. The potential of the portions eliminated by the light lowers similarly to the electrophotographic process, so that potential difference is produced between the portions exposed to the light and portions not exposed to the light, by which an electrostatic latent image is formed. In this embodiment, a light potential Vl which is the potential of the portion exposed to the light is Vl=−150V, while a dark potential which is the potential of the portion not exposed to the light remains Vd=−600V.

The electrostatic latent image formed on the image bearing member 1 through the latent image step is developed with the developer T by the developing device 3 through a so-called jumping developing method in which the member carrying the developer T is not contacted to the image bearing member 1.

The developing device 3 comprises a developing sleeve 3-*a* which is a rotatable developer carrying member enclosing a stationary developing magnet 3-*b*, a developing blade 3-*c* contacted to the outer surface of the developing sleeve 3-*a*, they developing container 3-*d* accommodating the developer T. The developing container 3-*d* contains the developer T and the electroconductive particles Z with a weight ratio of 1:1.5. Without a strong electric force, the most of the electroconductive particles Z move while being deposited on the developer T.

The surface of the developing sleeve 3-*a* is roughened, and carries, in a direction indicated by an arrow c, the developer T which is magnetic toner in cooperation with the magnetic force of the developing magnet 3-*b*. When the developer T passes through the contact portion relative to the developing blade 3-*c*, the thickness of the layer of the developer on the developing sleeve 3-*a* is regulated, and the developer is triboelectrically charged. The charging polarity of the developer T is determined by the material thereof, and is mainly negative in this embodiment. Simultaneously, the electroconductive particles Z passing through the region is electrically charged to the positive polarity.

Figure 2:
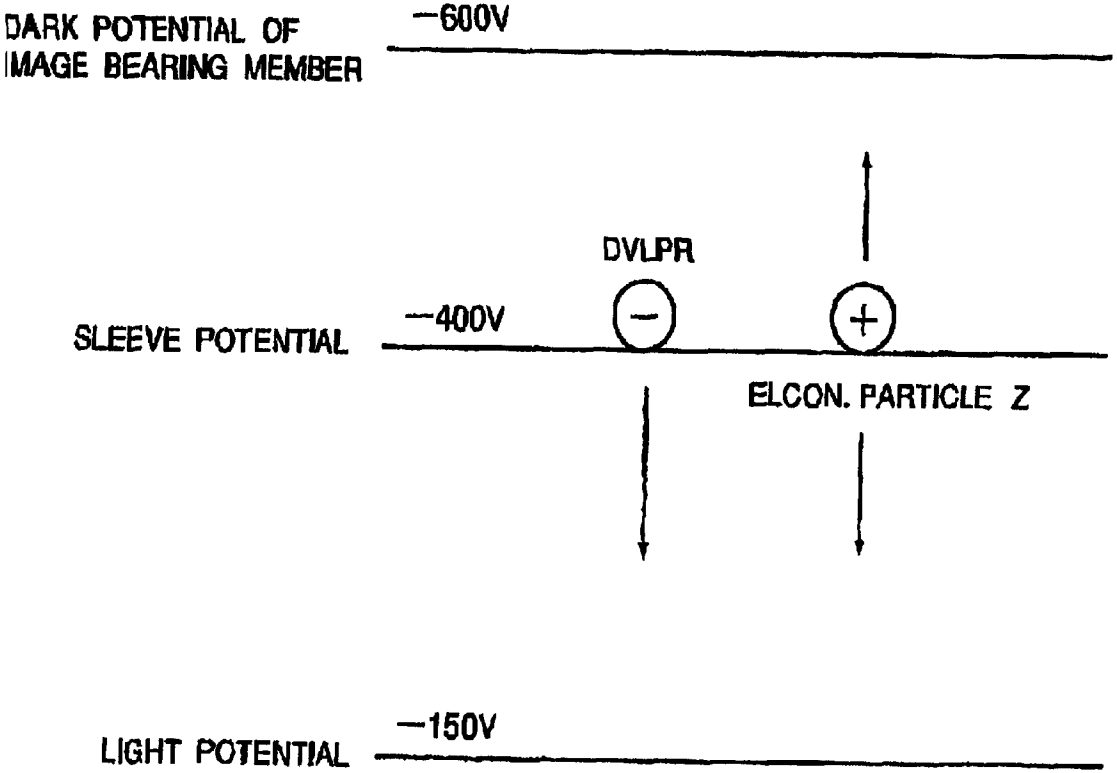
FIG. 2 is an illustration of behavior of developer and electroconductive particles in the developing zone.

Here, referring to FIG. 2, the description will be made as to the behavior of the charged developer T and electroconductive particles Z between the developing sleeve 3-*a* and the image bearing member 1.

When the developer T charged to the negative polarity reaches the region close to the image bearing member 1, it develops the electrostatic latent image by the electric field formed between the image bearing member 1 and developing sleeve 3-*a*. In this embodiment, the developing sleeve 3-*a* is supplied from a voltage source S2 with a voltage which is in the form of a DC voltage of −400V relative to the image bearing member 1 biased with an AC voltage which is a rectangular wave voltage having a frequency of 1500 Hz and a peak-to-peak voltage of 1600 vpp, so that in the gap of 300 $\mu$m formed between the image bearing member 1 and the developing sleeve 3-*a*, the developer T charged to the negative polarity does not jump to the dark portion potential portion where Vd=−600V, but jumps to the light portion potential portion where Vl=−150V.

The electroconductive particles Z charged to the positive polarity tend to jump to the dark portion potential electrically, contrary to the developer T, but because of the sizes thereof, many of them are deposited on the developer T per se. When the electrostatic force between the developer T is stronger, there are electroconductive particles Z which move in the same manner as the developer T, that is, not behave contrarily relative to the developer T. Therefore, the electroconductive particles Z are capable of jumping to the light portion potential portions and to the dark portion potential portions.

The developer T having moved to the image bearing member 1 in the developing process is transferred onto the transfer material P in the transfer step The transfer roller 5-*a* of the transferring device 5 is supplied, from a voltage source S3, with a DC voltage of +2 KV relative to the image bearing member 1 such that electric field is formed between the image bearing member 1 and transfer roller 5-*a*. Because of the electric field, the developer T which is charged to the negative polarity is attracted to the transfer roller 5-*a*, and therefore, most of the is transferred onto the transfer sheet P. On the other hand, as to the electroconductive particles Z charged to the positive polarity, most of the electroconductive particles Z deposited on the developer T are transferred onto the transfer sheet P together with the developer T, but from the electrical standpoint, they are stabilized when they are on the image bearing member 1, and therefore, many of them remain on the image bearing member 1, as compared with the developer T.

Most of the electroconductive particles z deposited on the dark potential portions remain on the image bearing member 1.

Accordingly, on the image bearing member 1 after the transfer step, there exists the small amount of the developer T in the light portion potential having remained despite the transfer step and a relatively large amount of the electroconductive particles Z remaining over the whole surface of the image bearing member 1.

Then, the developer T and the electroconductive particles Z on the image bearing member 1 passes by the charging sponge roller 2-A. The charging sponge roller 2-A is supplied with the voltage of −610V relative to the image bearing member 1, so that electroconductive particles Z charged to the positive polarity tends to move to the charging sponge roller 2-A from the surface of the image bearing member 1 charged to the more positive side than the charging sponge roller 2-A.

They are carried on the surface of the sponge, and function to electrically charge the image bearing member in the above-described manner.

On the other hand, most of the developers T not transferred but remaining on the image bearing member 1 are so-called reverse component which are charged to the positive polarity from the beginning and not easily transferred or which are charged to the positive polarity due to the transfer voltage. These developer T particles are deposited to the charging sponge roller 2-A. But, they become charged gradually to the negative polarity by passing, a plurality of times, through the region C where the charging process is carried out between the image bearing member 1 and the charging sponge roller 2-A. Therefore, the developer T which has a nature of easily charged to the negative polarity is charged to the negative polarity relatively soon, and most of them returns to the image bearing member 1, and then is mixed with the new developer T in the developing zone close to the developing sleeve 3-*a*. Thus, the electrophotographic process is implemented.

However, if the main assembly is forced to stop during developing process being executed, due to jamming of transfer sheet P or the like, the developer T is described over the area of the surface of the image bearing member 1 from the position close to the developing sleeve 3-*a* to the position contacted to the transfer roller but is not transferred onto the transfer sheet P. Upon the resumption of the main assembly of the apparatus, the image bearing member 1 rotates, and the developer T reaches the charging sponge roller 2-A.

Figure 3:
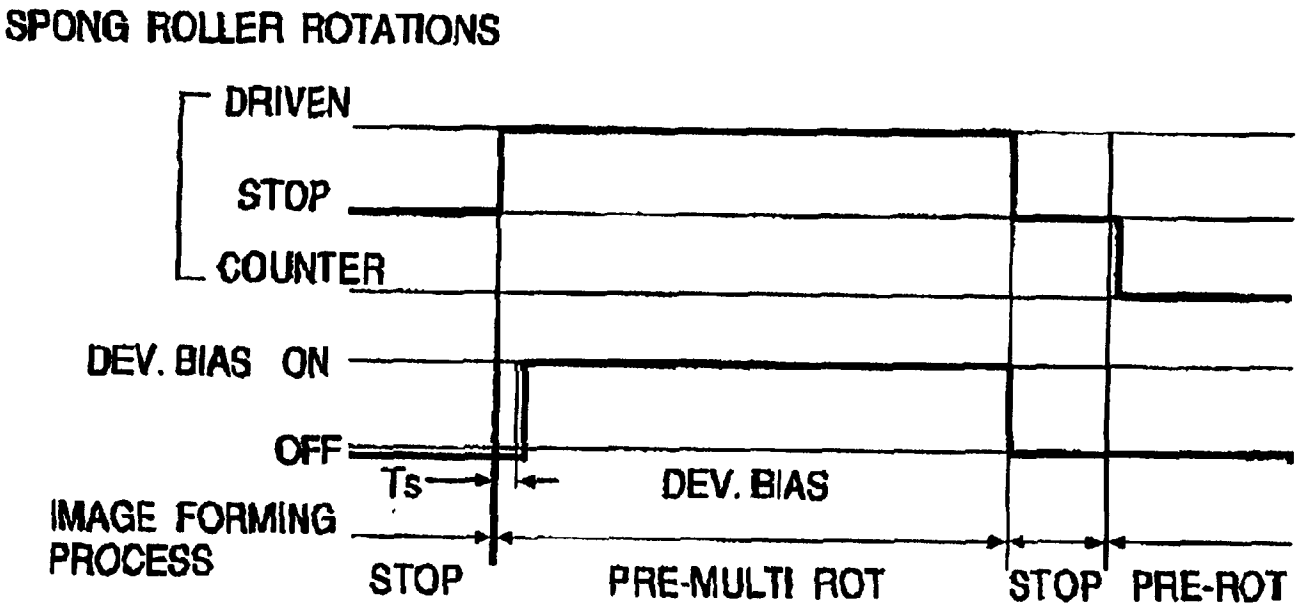
FIG. 3 shows a sequential control operation of the charging sponge roller and the developing bias voltage.

In this embodiment, as shown in FIG. 3, during a preprocess step (so-called preliminary multi-rotation or warming-up rotation) executed to place the main assembly of the apparatus in a stand-by state upon the resumption after the stop, the charging sponge roller is rotated by the image bearing member 1 (passive rotation) as indicated by an arrow r in FIG. 1 as is different from the normal image forming operation. Thus, the charging roller is driven by the image bearing member for the areas of the image bearing member 1 that is going to be a non-image forming area A bias is applied between the image bearing member 1 and the developing sleeve 3-*a*.

By doing so, even when a great amount of the developer T is present on the image bearing member 1, the developer T is permitted to pass since the charging sponge roller 2-A which is driven by the image bearing member, in other words, which follows the image bearing member, does not scrape the developer T off the image bearing member. Thus, the charging sponge roller 2-A is hardly contaminated by the developer T.

The developer T having passed by the contact surface C between the image bearing member 1 and the charging sponge roller 2-A comes to the position close to the developing sleeve 3-*a*, where the image bearing member 1 is positively caught and collected to the developing sleeve 3-*a* by the bias voltage applied between the image bearing member 1 and the developing sleeve 3-*a*. Therefore, the timing of the bias voltage may be delayed from the passive rotation by time Ts min. Which is the time required for the developer T passing through the contact area between the charging sponge roller and the image bearing member to move from the contact area to the developing zone which is close to the developing sleeve 3-*a*. Thus, a collecting electric field for collecting the developer T from the area which is going to be a non-image formation area of the image bearing member 1 to the developing sleeve 3-*a*.

Figure 5:
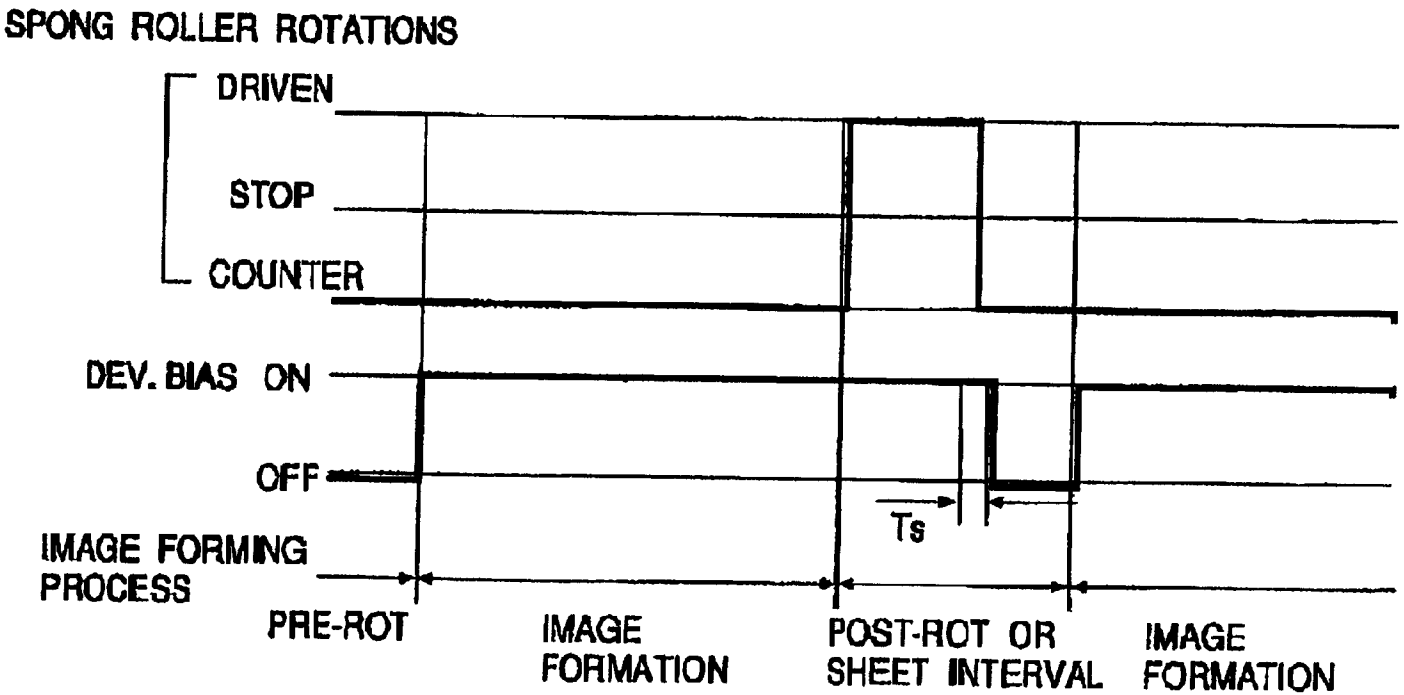
FIG. 5 shows a sequential control operation of the charging sponge roller and the developing bias voltage (second example).

Referring to FIG. 5, which shows the behavior of the developer T in this step in this embodiment, the description will be made as to the settings of the bias voltage applied to various members, the potentials thereof and the electrical relation or the like during the preliminary multi-rotation period.

Figure 4:
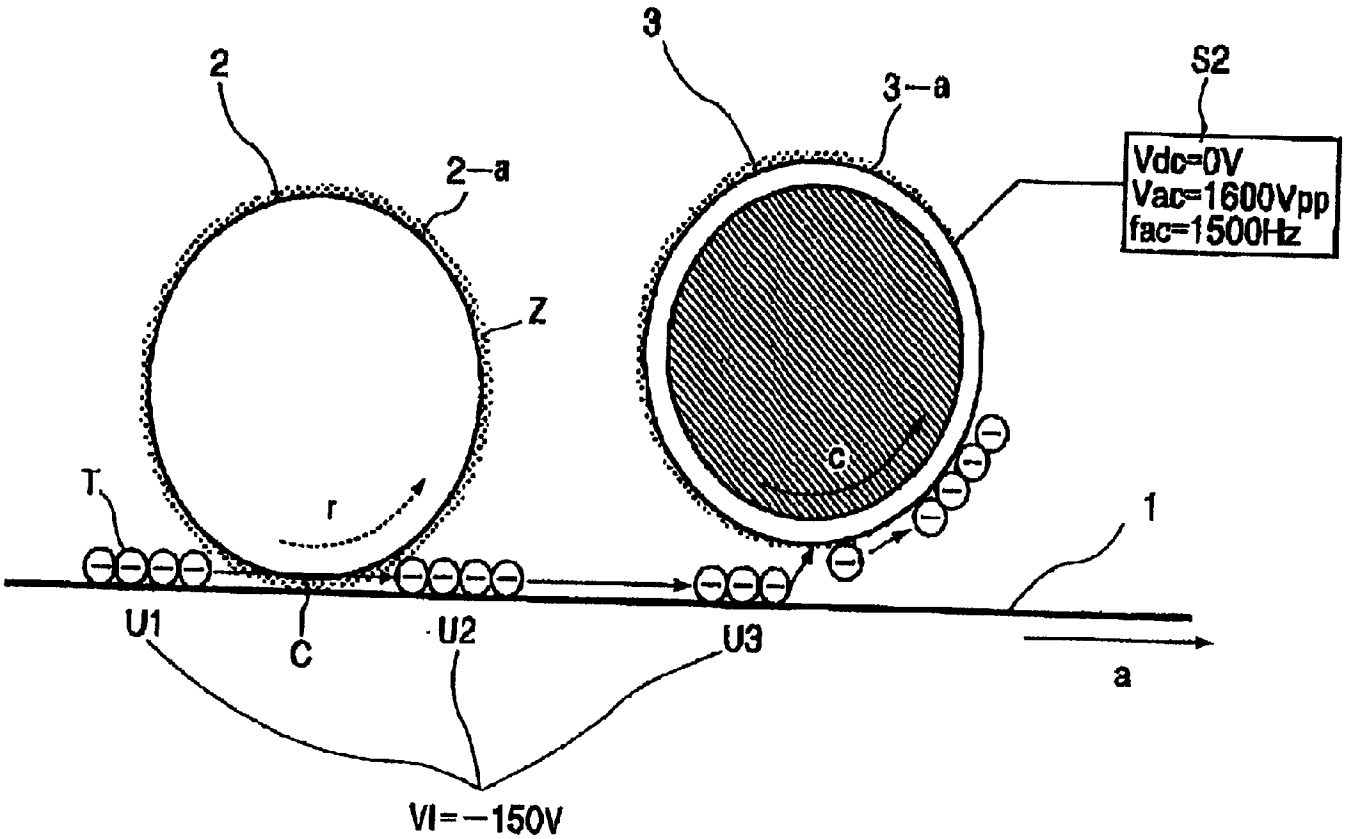
FIG. 4 is a schematic view illustrating a charging sponge roller and a developing bias control.

Similarly to an usual image forming apparatus, the image forming apparatus of this embodiment, the preliminary multi-rotation (warming-up rotation) is carried out after a process cartridge 10 is mounted to the main assembly, until the apparatus is placed into the stand-by state. During the preliminary multi-rotation period, the driving system is rotated. Therefore, when the process cartridge is reset after jam clearance operation for removing the jammed transfer sheet P, image bearing member 1 starts to rotate for the warming-up operation. In FIG. 4, the surface of the image bearing member 1 is schematic ally developed into a flat surface, and the rotational direction is indicated by arrow a.

When the main assembly of the apparatus stops during image forming operation due to jam of the transfer sheet P or the like, the developer T remaining on the image bearing member 1 is present at the light portion potential Vl portion which has been exposed by the exposure device 7. The polarity of the developer T is negative (regular charging polarity) as to most of the developer particles as indicated by U1 in FIG. 4, in this embodiment.

Since the transfer bias is not applied during the rotation of the image bearing member 1, the polarity state is retained, and the developer reaches the contact surface C between the charging sponge roller 2-A and the image bearing member 1. In this is embodiment, the charging sponge roller 2-A is electrically floating state, and therefore, the charge of the developer T or the potential of the surface of the image bearing member 1 are retained after the developer T is passed between the charging sponge roller 2-A and the image bearing member 1 (U2 in FIG. 4).

In this embodiment, the bias is in the form of a DC voltage of 0V biased with a rectangular wave AC voltage having a frequency of 1500 Hz, and a peak-to-peak voltage of 1600 vpp. By this, the developer T charged to the negative polarity is attracted from the image bearing member 1 where the potential is −150V approx. (non-image area) to the developing sleeve 3-*a* where the potential is 0V which is positive side than −150V, and therefore, is collected into the developing device 3. The potential (0V) for the developer collection developer applied to the developing sleeve is different from the normal image formation formation potential (−400V) applied to the developing sleeve.

In this embodiment, the image bearing member 1 rotates seven full-turns in the normal preliminary multi-rotation. Therefore, the developer T collection step in the developing device 3 is repeated seven time, which have been enough to completely remove the developer T from the image bearing member.

In this embodiment, the contrast potential difference between the light portion potential on the image bearing member 1 and the developing sleeve 3-*a* is 150V, the collection efficiency increases with increase of the contrast of the polarity opposite from that of the developer T toward the developing sleeve 3-*a*. However, if the contrast is too large, the field intensity relative to the dark portion potential (not exposed) is too strong with the result of discharge current between the image bearing member 1 and the developing sleeve 3-*a*. In an extreme case, the developer T is deposited onto the image bearing member 1 from the developing sleeve 3-*a*. In addition, at the boundary between the light portion potential and the dark portion potential, it is not easy to collect the developer T because of the so-called edge effect.

When such is significant and therefore the collection efficiency of the developer T is not high, the image bearing member 1 having the developer T deposited thereto may be subjected to a uniform whole surface exposure, by which the collection efficiency can be raised. By the whole surface exposure, the edge effect is killed, and therefore, the developer can be removed at the edge portion of letter pattern for example and can be collected. In addition, the dark portion potential portion can be eliminated from the image bearing member 1, and therefore, the electric discharge phenomenon does not easily occur even if the contrast between the light portion potential and the developing sleeve 3-*a* so that large contrast can be used, thus further improving the collection efficiency of the developer T.

In this embodiment, as described above, the developer collection sequential operation in which the charging sponge roller is driven by the image bearing member 1 and the developing sleeve 3-*a* is supported with a bias voltage, is carried out always during the preliminary multi-rotation. However, in a system in which the developer T having passed by the charging sponge roller on the image bearing member 1 is easily collected by the developing sleeve 3-*a*, a shorter period of the collection step is usable.

On the other hand, in a system in which the developer T is not easily removed from the image bearing member 1, as shown in FIG. 5, the collection step may be carried out not only during the preliminary multi-rotation step but also in a post-rotation period and/or in the intervals between adjacent sheets in initial certain parts of the subsequent series of image forming operation. It is preferable that application of the bias voltage continues from after completion of the driven rotation of the charging sponge roller 2-A for the time period required for a point on the image bearing member moves from the contact surface C relative to the charging sponge roller 2-A to the neighborhood of the developing sleeve 3-*a* plus Ts.

In the system of this embodiment is a so-called cleanerless system in which there is no cleaning step for removing the residual developer T between the contact portion of the image bearing member 1 to the transfer roller 5-*a* and the contact portion C relative to the charging sponge roller 2-A. However, the present invention is applicable to a system in which a contact member such as a brush is contacted to the image bearing member 1 at a position between them, as long as the contact member is not for collecting the developer T but for dispersing the developer T or the like.

According to this embodiment, even if the developer T not transferred onto the transfer sheet P remains on the image bearing member 1 upon emergency stop of the main assembly due to jamming of the transfer sheet P during image forming operation, the developer T is effectively prevented from depositing on the charging sponge roller 2-A, and therefore, the improper charging attributable to contamination of the charging sponge roller 2-A with the developer T.

(Second Embodiment)

Figure 6:
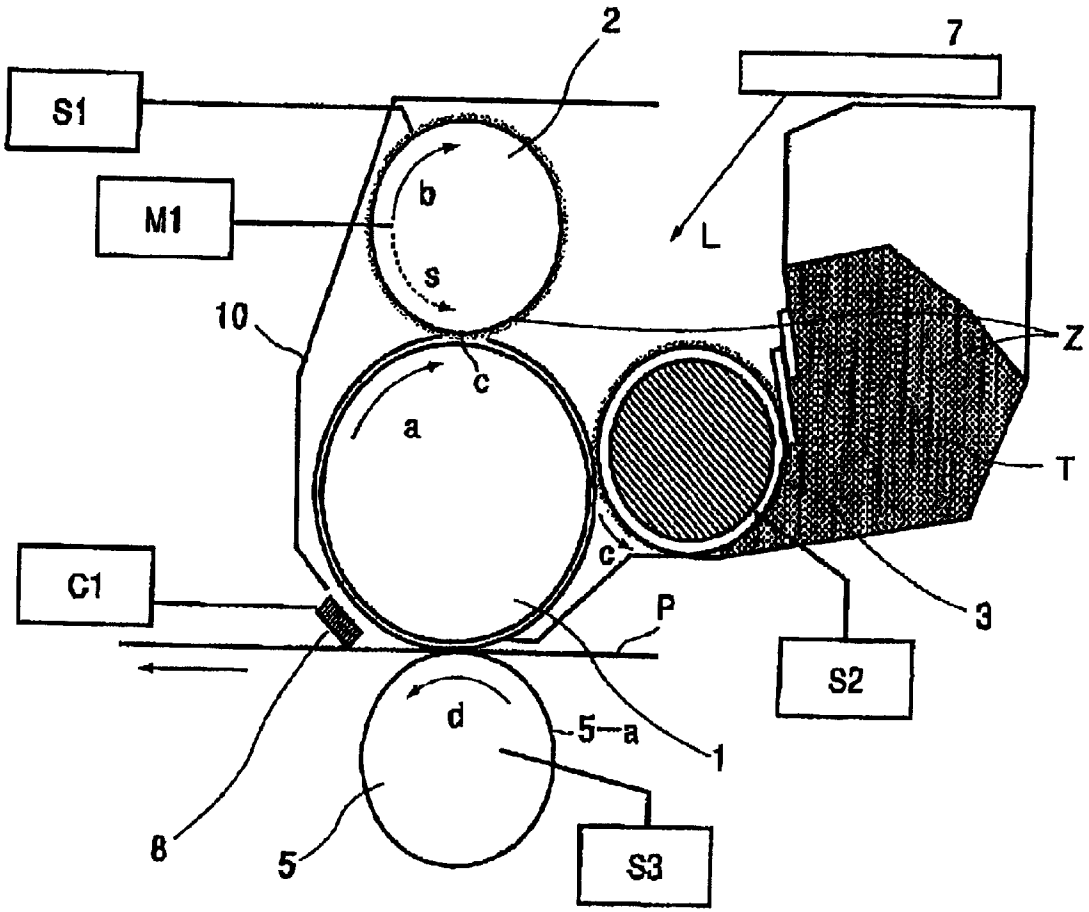
FIG. 6 is a schematic view of an image forming apparatus according to a second embodiment of the present invention.

FIG. 6 is a schematic sectional view of an image forming apparatus according to a second embodiment of the present invention. The image forming apparatus has the same structures as that of the first embodiment unless otherwise described.

In this embodiment, a developer detecting sensor 8 is provided over the whole surface in the rotational axis of the image bearing member downstream of a contact portion between the image bearing member 1 and the transfer roller 5-*a* of the transferring device 5.

The developer detecting sensor 8 detects deposition of the developer T on the image bearing member 1 by detecting a light density of the surface of the image bearing member 1.

In this embodiment, simultaneously with starting of the preliminary multi-rotation, the developer detecting sensor 8 detects the developer T on the image bearing member 1. The signal from the developer detecting sensor 8 is written in the control circuit C1 for controlling the preliminary multi-rotation, and on the basis of the output thereof, the bias voltage applied to the developing sleeve 3-*a*, the exposure signal for the image bearing member 1, rotation of the image bearing member 1 and the rotation of the charging sponge roller 2-A, or the like are controlled.

Simultaneously with the preliminary multi-rotation, the charging sponge roller 2-A is driven by the image bearing member 1 similarly to the first embodiment. When the developer detecting sensor 8 detects the existence of the developer T in an amount exceeding a predetermined level, the position where the developer T disappears is stored as data m, and said developer detecting sensor 8 continues detection for the time Td of one full-rotation of the image bearing member 1.

The bias voltage applied to the developing sleeve, the exposure signal for the image bearing member 1 and the bias applied to the charging sponge roller is similar to those in the sequential operation for collecting the developer T from the image bearing member 1 in the first embodiment.

By this, the developer T on the image bearing member 1 passes through an electric field provided by the bias voltage applied between the developing sleeve and the image bearing member 1 for the time Td, and therefore, a large amount of the developer T can be collected into the developing device 3.

If the developer detecting sensor 8 does not detect the existence of the developer T, it is discriminated that developer T on the image bearing member 1 has sufficiently been collected, and a completion signal Se of the collection sequential operation is written in the control circuit C1.

When the developer detecting sensor 8 detects the existence of the however for time Td, the position where the developer T disappears is stored as renewed m, and these operations are repeated until the existence of the developer T is not detected for time Td. Upon the end of the operations, a completion signal Se of the collection sequential operation for the developer T is written in the control circuit C1.

In this embodiment, completion signals Sm of the other sequential operations necessary for preparation of the image formation are written in the control circuit C1 during the preliminary multi-rotation. Upon the writing of the signal Se and the signal Sm, the preliminary multi-rotation ends. By this, the step necessary and sufficient for the driven rotation of the charging sponge roller 2-A is provided.

In this embodiment, the developer detecting sensor 8 is based on a light density, but the other detecting means using amount of electric charge or resistance value of the developer T is usable.

According to this embodiment, too, even if the developer T not transferred onto the transfer sheet P remains on the image bearing member 1 upon emergency stop of the main assembly due to jamming of the transfer sheet P during image forming operation, the developer T is effectively prevented from depositing on the charging sponge roller 2-A, and therefore, the improper charging attributable to contamination of the charging sponge roller 2-A with the developer T.

(Others)

1) The contact charging member is not limited to the structures used in the foregoing embodiments.

2) The charging bias to be applied to the contact charging member or the developing bias to be applied to the developing member may be in the form of a DC voltage biased with an alternating voltage (AC voltage).

The waveform of the alternating voltage is optional; the alternating wave may be in the form of a sine wave, a rectangular wave, a triangular wave, or the like. Also, the alternating current may be constituted of an alternating current in the rectangular form which is generated by periodically turning on and off a DC power source. In other words, the waveform of the alternating voltage applied, as the charge bias, to a charging member or a development member may be optional as long as the voltage value periodically changes.

3) The choice of the means for exposing the surface of an image bearing member to form an electrostatic latent image does not need to be limited to the laser based digital exposing means described in the preceding embodiments. It may be an ordinary analog exposing means, a light emitting element such as a LED, or a combination of a light emitting element such as a fluorescent light and a liquid crystal shutter. In other words, it does not matter as long as it can form an electrostatic latent image correspondent to the optical information of a target image.

The image bearing member may be an electrostatic recording dielectric member or the like. In such a case, the dielectric member surface is uniformly charged (primary charging) to a predetermined polarity and potential, and thereafter, the selective discharging is effected by discharging needle head, electron gun or another discharging means to form an intended electrostatic latent image.

4) The developing means 3 is not limited to a particular type.

5) The recording material which receives the toner image from the image bearing member may be an intermediary transfer member such as a transfer drum, a transfer belt.

As described in the foregoing, in a cleanerless type image forming apparatus the charging means having a charging member rotated in contact with the image bearing member is used for electrically charging the image bearing member, improper charging or the like attributable to excessiveness of the residual developer carried over to the contact portion between the image bearing member and the charging member is effectively prevented, so that output image quality can be maintained or improved.

While the invention has been described with reference to the structures disclosed herein, it is not confined to the details set forth and this application is intended to cover such modifications or changes as may come within the purpose of the improvements or the scope of the following claims.

What is claimed is:

1. An image forming apparatus comprising:

an image bearing member;

a charging member, contactable to said image bearing member, for electrically charging said image bearing member at a charging position; and developing means for developing an electrostatic image formed on said image bearing member with a developer, wherein (i) when a first area on said image bearing member, which is going to be an image formation area is at the charging position, said charging member moves with a peripheral speed difference relative to said image bearing member, and (ii) when a second area on said image bearing member, which is a part of an area which is going to be a non-image formation area is at the charging position, said charging member moves substantially without a peripheral speed difference relative to said image bearing member, and wherein said developing means is supplied with a voltage so as to provide a collecting electric field for collecting the developer from the second area to said developing means.

2. An apparatus according to claim 1, wherein said charging member is a rotatable member, and said charging member rotates in a direction of counterdirectional peripheral movement relative to said image bearing member when the first area is at the charging position.

3. An apparatus according to claim 1, wherein said charging member is a rotatable member, and said charging member is driven by rotation of said image bearing member when the first area is at the charging position.

4. An apparatus according to claim 1, wherein said developing means is capable of collecting a residual developer from said image bearing member.

5. An apparatus according to claim 1, wherein said developing means is supplied with a voltage for the first area and another voltage for the second area, wherein the voltage for the first area is different from the voltage for the second area.

6. An apparatus according to claim 1, wherein the collecting electric field is formed after a jam clearance operation.

7. An apparatus according to claim 1, further comprising:

transferring means for transferring a developed image from said image bearing member onto a transfer material; and detecting means, disposed downstream of said transferring means and upstream of said charging member with respect to a moving direction of a surface of said image bearing member, for detecting the developer on said image bearing member, wherein the collecting electric field is formed on the basis of an output of said detecting means.

8. An apparatus according to claim 1, wherein said image bearing member is a photosensitive member, and said apparatus further comprises:

exposure means for exposing said photosensitive member to form an electrostatic image on said photosensitive member, wherein said exposure means uniformly exposes the second area.

9. An apparatus according to claim 1, wherein electroconductive particles are provided in a contact portion between said charging member and said image bearing member.

10. An apparatus according to claim 9, wherein said charging member comprises a foam surface layer.

11. An apparatus according to claim 4, wherein said developing means is capable of collecting a developer on said image bearing member simultaneously with a developing operation.

* * * * *

UNITED STATES PATENT AND TRADEMARK OFFICE

CERTIFICATE OF CORRECTION

PATENT NO. : 6,963,700 B2
DATED : November 8, 2005
INVENTOR(S) : Yasushi Shimizu et al.

It is certified that error appears in the above-identified patent and that said Letters Patent is hereby corrected as shown below:

Title page,
Item [75], Inventors, "Hiroshi Satoh, Mishima (JP);" should read -- Hiroshi Sato, Toride (JP); --.

Drawings,
Sheet 3, Fig. 3, "SPONG" should read -- SPONGE --.
Sheet 5, Fig. 5, "SPONG" should read -- SPONGE --.

Column 2,
Line 22, "there" should read -- there is --.

Column 3,
Line 20, "t image" should read -- the image --.

Column 4,
Line 32, "device" should read -- device), --.
Line 33, "like. Image" should read -- like, or an image --.
Line 34, "that" should read -- that an --.
Line 44, "transfer," should read -- transferred, --.
Line 47, "sheet" (first occurrence) should read -- sheet) --.

Column 5,
Line 30, "i imported" should read -- is imported --.
Line 33, "collection" should read -- collected --.

Column 6,
Line 21, "assuring" should read -- assure --.
Line 36, "or is" should read -- or if --.

Column 9,
Line 9, "have" should read -- having --, and "a" should read -- and a --.
Line 62, "they" should read -- and a --.

Column 10,
Line 11, "is" should read -- are --.
Line 45, "step The" should read -- step. The --.
Line 52, "of the" should read -- of the developer T --.

Column 11,
Line 26, "of" should be deleted.
Line 28, "returns" should read -- return --.
Line 50, "area A" should read -- area. A --.

UNITED STATES PATENT AND TRADEMARK OFFICE

CERTIFICATE OF CORRECTION

PATENT NO. : 6,963,700 B2
DATED : November 8, 2005
INVENTOR(S) : Yasushi Shimizu et al.

It is certified that error appears in the above-identified patent and that said Letters Patent is hereby corrected as shown below:

Column 12,
Line 7, "which" should be deleted.
Line 26, "schematic ally" should read -- schematically --.
Line 56, "formation" (second occurrence) should be deleted.
Line 61, "time," should read -- times, --.

Column 14,
Line 50, "of the however" should be deleted.
Line 65, "using" should read -- using an --.

Column 15,
Line 6, "charging" should read -- charging is --.
Line 39, "by" should read -- by a --.
Line 46, "a" (second occurrence) should read -- or a --.

Signed and Sealed this

Thirteenth Day of June, 2006

JON W. DUDAS
*Director of the United States Patent and Trademark Office*